United States Patent [19]

Wolde-Tinase

[11] 4,400,927

[45] Aug. 30, 1983

[54] METHOD OF FORMING A SKELETAL DOME STRUCTURE IN SITU

[75] Inventor: Amde M. Wolde-Tinase, Ames, Iowa

[73] Assignee: Iowa State Research Foundation, Inc., Ames, Iowa

[21] Appl. No.: 167,808

[22] Filed: Jul. 14, 1980

[51] Int. Cl.[3] ..... E04B 1/00

[52] U.S. Cl. ..... 52/745; 52/82; 52/223 R; 52/644; 52/730; 29/446

[58] Field of Search ..... 52/80, 82, 642, 644, 52/745, 225, 226, 730, 223 R, 727; 156/163, 196, 212; 29/446

[56] References Cited

U.S. PATENT DOCUMENTS

| | | | |
|---|---|---|---|
| 2,039,398 | 5/1936 | Dye | 52/730 |
| 2,609,068 | 9/1952 | Pajak . | |
| 2,654,686 | 10/1953 | Hansen . | |
| 2,704,587 | 3/1955 | Pajak . | |
| 3,085,366 | 4/1963 | Jamison . | |
| 3,300,839 | 1/1967 | Lichti | 52/729 X |
| 3,349,525 | 10/1967 | Payne | 52/223 R X |
| 3,391,511 | 7/1968 | Harris et al. . | |
| 3,417,520 | 12/1968 | Fink | 52/80 |
| 3,495,816 | 2/1970 | Lyle | 52/732 X |
| 3,617,416 | 11/1971 | Kremrey | 156/173 |
| 3,763,608 | 10/1973 | Chamlee | 52/80 |
| 3,884,646 | 5/1975 | Kenney | 156/196 X |
| 3,924,367 | 12/1975 | Stewart | 52/80 |
| 3,999,337 | 12/1976 | Tomassetti, Jr. et al. | 52/82 |
| 4,133,150 | 1/1979 | Yacobuni | 52/80 |

*Primary Examiner*—Carl D. Friedman

*Attorney, Agent, or Firm*—Tilton, Fallon, Lungmus

[57] ABSTRACT

A skeletal dome structure composed of a plurality of arcuate support beams joined at their upper ends to a central hub and radiating outwardly and downwardly to terminate at points of engagement with a support surface. Each support beam is composed of an elongated lightweight core sandwiched between upper and lower strips of a material having high tensile and compressive strength. In making the dome, each beam is first preassembled to the extent that the core thereof is secured to a first strip, that strip is then attached at one end to the central hub, the first strip and core are then longitudinally flexed to develop a convex curvature along the side of the core opposite from the strip, and a second flexible strip is then secured to the convex side of the core. A plurality of such beams may be simultaneously formed into buckled or arcuate shape by connecting a plurality of the first strips to a single hub and then raising the hub to impart a curvature into each of the partially-finished beams, followed by the final step of securing the outer strips or skins to the convex upper surfaces of all of the outwardly-radiating arcuate members.

4 Claims, 15 Drawing Figures

METHOD OF FORMING A SKELETAL DOME STRUCTURE IN SITU

BACKGROUND AND SUMMARY

While various types of pre-formed multi-layered structure members have been used in the construction field, there is nevertheless a need for a skeletal structural system composed of components which are relatively light in weight, easily transported to the construction site, and readily assembled to provide a strong and rigid framework for a protective dome. Ideally, such a structure would also be capable of being readily dismantled. The dome might be used as temporary shelter for expositions or for construction sites in extreme climates, as an enclosure for radar antennae, radio telescopes, or grain storage depots, as a cover for stadiums, swimming pools, park areas, and the like.

Accordingly, it is an object of this invention to provide a dome framework formed principally of arcuate beam elements which are formed of components which arrive at the construction site in flat or linear form. Another object is to provide a dome structure in which the major frame elements take the form of arcuate support beams, each beam having a lightweight longitudinally-curved core sandwiched between a pair of arcuate strips of material having high tensile and compressive strength.

Another object of this invention lies in providing a method of erecting a dome structure having a framework composed of arcuate support beams, wherein each of the support beams is developed on site by first securing a straight, elongated, flexible core to one side of a narrow skin or strip having high compressive and tensile strength, then longitudinally flexing the strip and core to force the side of the core opposite from the strip into convex configuration, and then securing a second flexible strip of high compressive and tensile strength to the convex side of the core. In the formation of a dome, each such composite beam becomes one of a multiplicity of arcuate struts radiating outwardly and downwardly from the apex of the dome. Each core member and the lower strip to which it is secured are first joined to a central member or hub, before any flexure of the strut takes place, and the second or upper strip of each strut is similarly secured to one end to the hub but is otherwise left unsecured to the core therebelow. Thereafter, the hub is raised from the ground or other supporting surface and the outer ends of the outwardly-radiating partially-formed struts are drawn inwardly towards the axis of the hub to develop a curvature in each core and lower strip and to produce the general dome configuration. As the final steps of the construction of the basic framework, the outer ends of the upper strips are drawn downwardly towards the fixed ends of the arcuate cores and lower strips, and such upper strips, now having been flexed into arcuate configuration, are rigidly secured along their lengths to the core structures.

Other features, objects, and advantages will become apparent from the specification and drawings.

DRAWINGS

DETAILED DESCRIPTION

Figure 1:
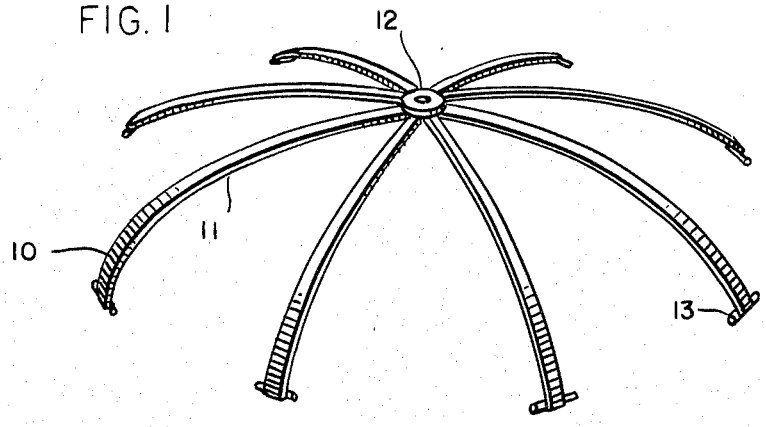
FIG. 1 is a perspective view of a dome framework embodying the present invention.
Figure 2:
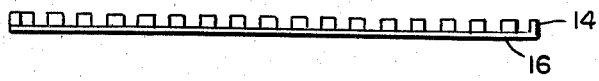
FIG. 2 is a side elevational view showing a first step in the construction of the dome wherein a core is secured to a flexible lower strip.

FIG. 1 illustrates the framework or skeleton 10 of the dome structure, the framework being composed of a plurality of outwardly and downwardly curved beams or struts 11 radiating from a central member or hub 12. The struts are similar in construction to each other and have their outer ends fixed by suitable attachment means to a horizontal support surface (not shown), normally the ground or a suitable foundation placed on the ground. In the illustration given, the attachment means takes the form of a plurality of anchoring members 13 which may be partially imbedded in or otherwise rigidly secured to the supporting surface. Alternatively, the attachment means may take the form of a ring which circumscribes or is otherwise anchored to the outer ends of the struts.

Figure 6:
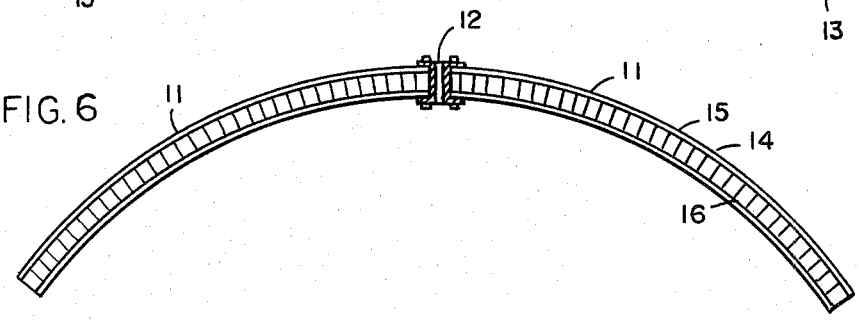
FIG. 6 is a vertical sectional view of the dome showing a pair of the interconnected struts following complete attachment of the upper strips.
Figure 7:
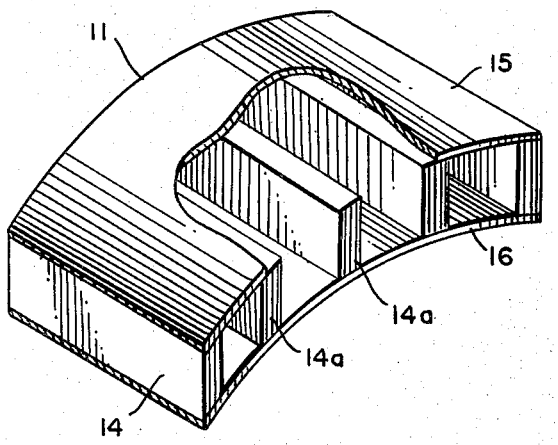
FIG. 7 is a fragmentary perspective view of a portion of a strut showing one form of core structure therefor.
Figure 8:
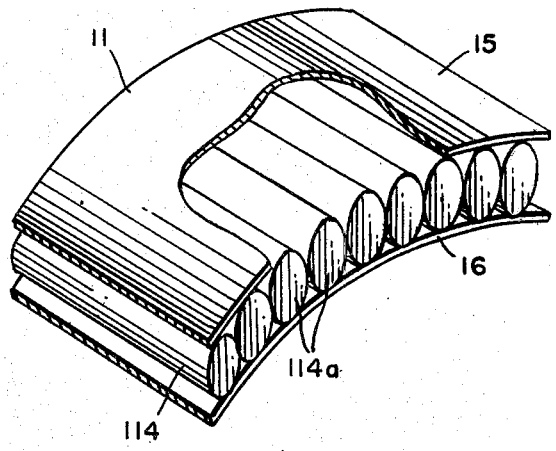
FIG. 8 is another fragmentary perspective view similar to FIG. 7 but showing a second type of core structure.
Figure 9:
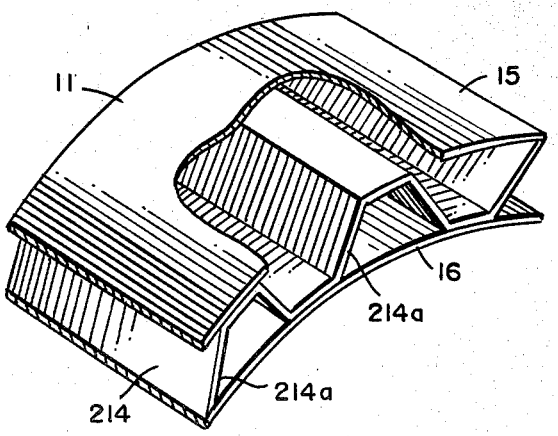
FIG. 9 is a fragmentary perspective view similar to FIGS. 7 and 8 but showing a third form of core structure.
Figure 10:
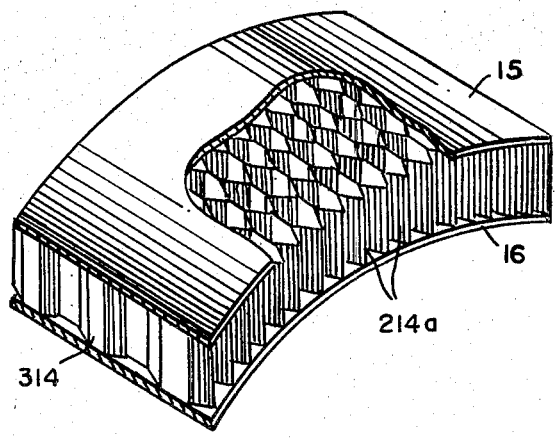
FIG. 10 is a fragmentary perspective view similar to FIGS. 7–9 but depicting a fourth form of core structure.
Figure 11:
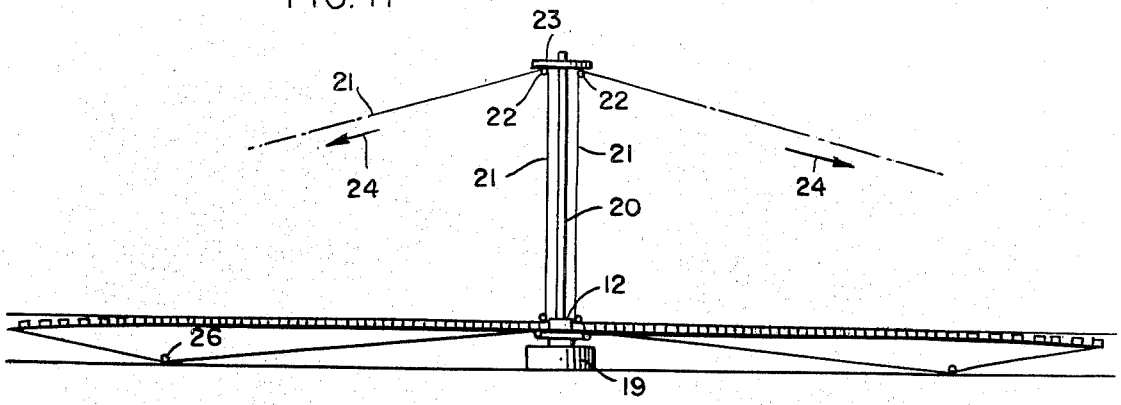
FIG. 11 is a somewhat schematic side view depicting the erecting structure for the dome framework.
Figure 12:
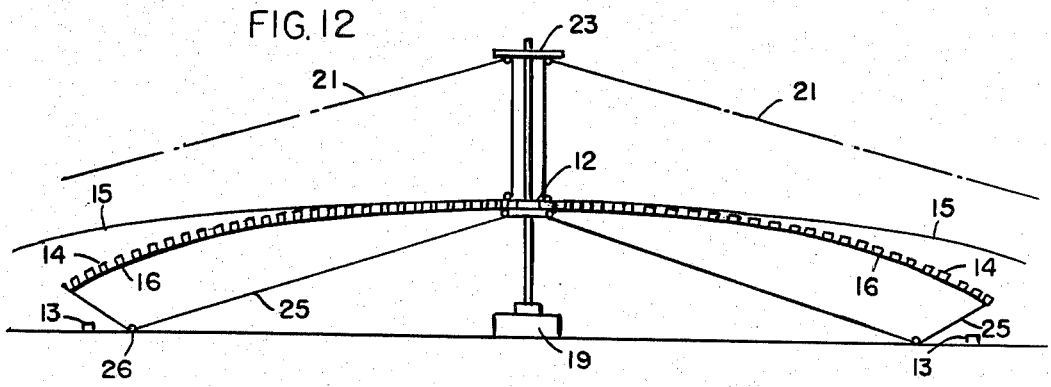
FIG. 12 shows the structure of FIG. 11 as forces are generated to buckle or bend the partially-formed struts of the dome.
Figure 13:
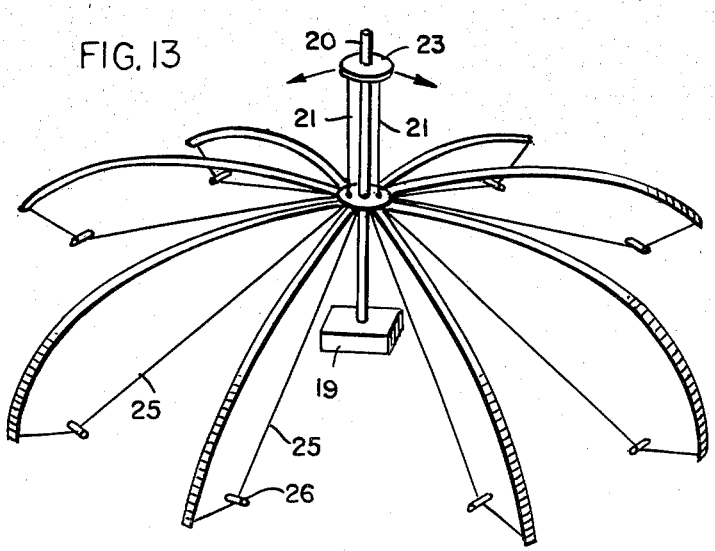
FIG. 13 is a somewhat schematic perspective view depicting a final stage in the erection procedure wherein the dome framework assumes the configuration of the final structure of FIG. 1.
Figure 14:
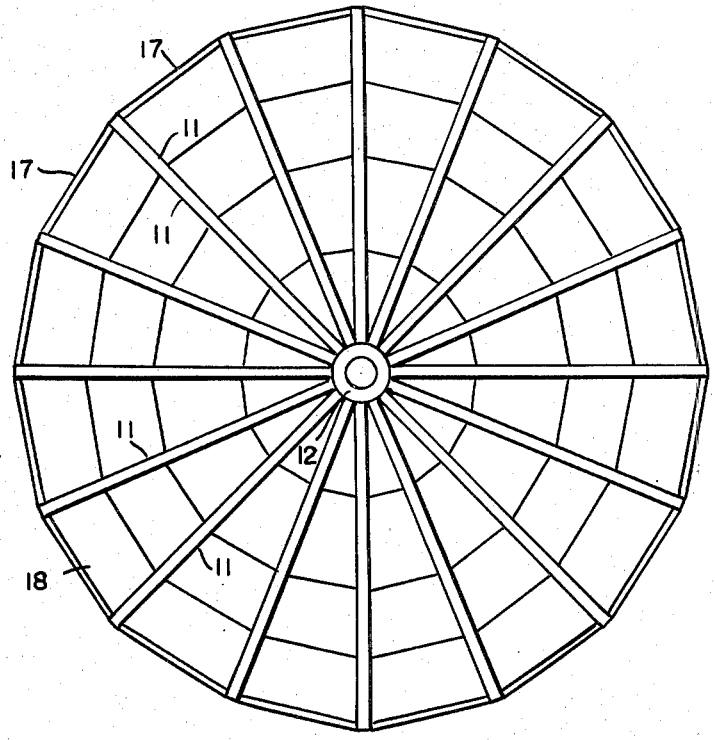
FIG. 14 is a top plan view of the dome structure after reinforcing members have been inserted into one of the segments between a pair of adjacent struts.
Figure 15:
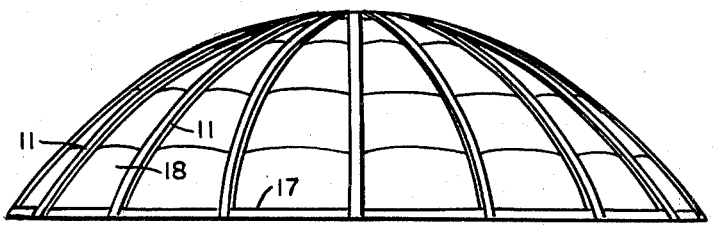
FIG. 15 is a side elevational view of the structure of FIG. 14.

Each strut or beam 11 comprises an elongated core 14 sandwiched between a pair of upper and lower strips or skins 15 and 16. FIG. 7 reveals details of construction of the struts 11 depicted in FIGS. 1 and 6. In that embodiment, the core is composed of a series of transverse spacers or blocks 14*a*. In the absence of strips 15 and 16, the core 14 has no structural integrity, although it is to be understood that some flexible interconnections might be provided between the transverse spacer elements 14*a* for the purpose, among others, of facilitating assembly of the parts. The core, whether composed of spaced discontinuous elements or of contacting discontinuous elements (FIG. 8) or of unified or continuous elements (FIGS. 9 and 10) is secured to strips 15 and 16 by means of welds, adhesives, screws, or other suitable connecting means. In the embodiment of FIG. 8, the core 114 is composed of transverse rod-shaped elements 114*a* disposed in contiguous relation with respect to each other and secured by any suitable means to the upper and lower strips 15 and 16. In FIG. 9, core 214 is formed of a web of material bent along transverse lines to define corrugations 214*a*, such corrugations being securely attached to the upper and lower strips 15 and 16, whereas in FIG. 10 the core 314 takes the form of a honeycomb pattern of interconnected elements 314*a* joined to the upper and lower strips 15 and 16. In all of the forms, the core is capable of providing substantial resistance to forces perpendicular to the surfaces of strips 15 and 16—that is, to either forces of compression or of separation—without preventing or significantly resisting forces of longitudinal flexure with respect to the core (and strut) as a whole. In each of the forms illustrated in FIGS. 7–10, the elements of the core, even if integrated (as in FIGS. 9 and 10) would be capable of being moved towards and away from each other in directions longitudinal to the strut 11 if it were not for the fact that strips 15 and 16 are securely fastened to the core elements.

Each of the elongated strips 15 and 16 is formed of a strong flexible material having relatively high compressive and tensile strength. Metals such as steel and aluminum are particularly effective but other materials such as glass fiber composites or polymeric compositions having similar properties may be used. Also, it is to be understood that the upper and lower strips need not be of the same material, and that in order to achieve the desired characteristics, one or both of the strips may be laminated or composed of two or more dissimilar materials (e.g., glass fibers embedded in a polymeric matrix). Weight may be a significant factor with lighter weight materials for both the strips 15, 16 and the core 14 generally being preferred.

Figure 3:
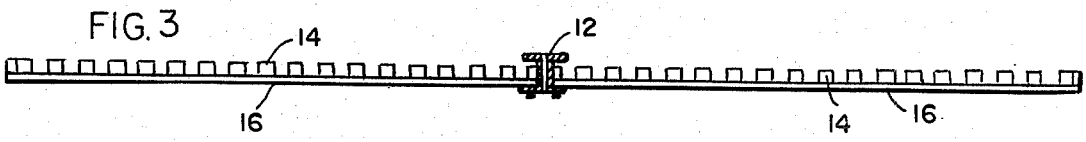
FIG. 3 illustrates a pair of the core/strip structures of FIG. 2 secured to a central hub.
Figure 4:
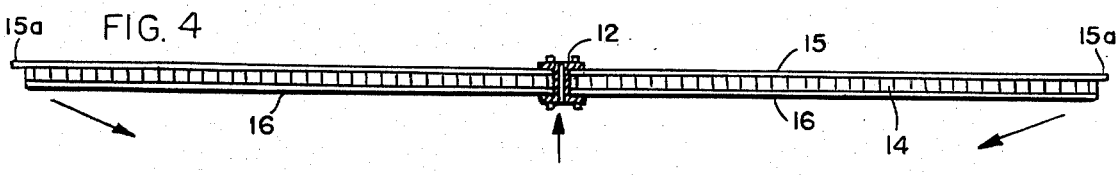
FIG. 4 depicts the assembly of FIG. 3 to which a pair of upper strips are also secured to the hub but remain otherwise unsecured to the cores therebelow. Arrows in FIG. 4 indicate the directions of applied forces which then cause the assembly to assume an arched or arcuate configuration.
Figure 5:
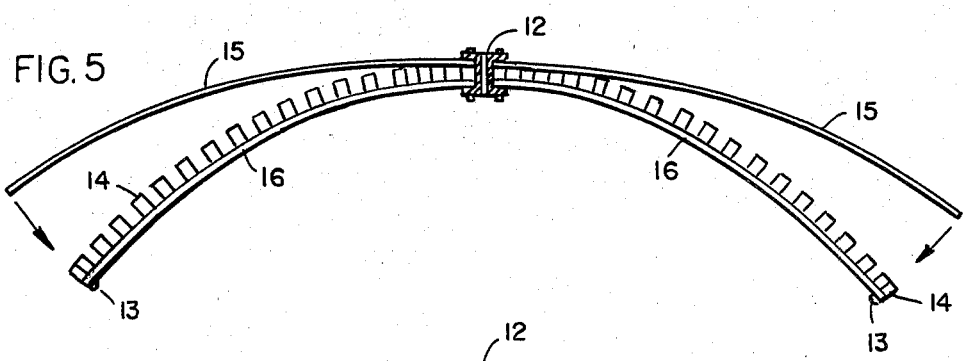
FIG. 5 shows the lower strips and cores fully arched and the upper strips in the process of being drawn downwardly into contact with the core structures.

FIGS. 2–6 schematically illustrate the steps of forming the skeletal structure 10 of FIG. 1. As a first step, an elongated core 14 is secured to a lower flexible strip 16 to form a partial assembly of a strut 11. A multiplicity of such assemblies is then arranged as depicted in FIG. 3 with their ends bolted or otherwise securely fastened to the central member or hub 12. Upper strips 15 and then fitted in place over the pre-formed cores 14 with their adjacent ends bolted or otherwise secured to hub 12 (FIG. 4). It is to be noted that when the strut assemblies are in the flat or linear condition depicted in FIG. 4, the upper strips 15 have free ends 15*a* projecting beyond the distal limits of the cores 14. Since the upper strips 15 are not connected to the cores 14 except at hub 12, the application of forces upon the lower strips 16 in the directions indicated in FIG. 4 is not necessarily accompanied by flexure of upper strips 15. Specifically, hub 12 may be elevated, and the free ends of lower strips 16 may be urged radially inwardly, thereby causing a flexing or bowing of the lower strips and cores mounted thereon, without also forcing the upper strips 15 into arcuate configuration. Flexure of the lower strips 16 is continued until the outer ends of those strips have been shifted inwardly into preselected locations and have been secured by connecting means 13 to the supporting surface. Thereafter, the free ends of upper strips 15 are urged downwardly, as indicated by the arrows in FIG. 5, until such strips are fully flexed into contiguous relation with the arched cores 14. The upper strips or skins are thereafter secured to the cores 14, preferably along the full length of such cores, to produce the final strut construction depicted in FIGS. 6 and 1.

The result is a framework of arcuate struts which is of high strength for its weight. Deflecting forces tending to flex or deform the arcuate struts in directions perpendicular to strips 15 and 16 are effectively resisted by the spaced parallel strips 15 and 16, by the high compressive and tensile strength of those strips, and by reason of the fact that they are secured to core structures which are highly resistant to deforming forces extending in directions perpendicular to the skins or strips. Since the skeleton is formed of components which are linear in their untensioned state, such components may be readily transported to and assembled at the construction site. Where the means for securing the strips 15, 16 to the core elements 14 are separable, as in the case of bolts or screws, disassembly of the skeletal structure may also be easily accomplished whenever dismantling is desired. The strips or skins 15, 16 will remain elastic during construction and under service loads. The proposed construction procedures insure that the thin, elastic, and originally-straight skins remain elastic during construction and throughout use. Thus, after disassembly the skins or strips will rebound back to their original straight configuration.

Since the flexible, elastic strips 15, 16 are not permanently deformed, and since the curvature of each strip is developed prior to attachment of the second strip to the core structure, the strips 15, 16 of each beam assembly will be stressed even when that assembly is not subjected to external forces or loads. Specifically, when an arcuate beam assembly is under a no-load condition, the arcuate strip 16 disposed along the concave side of core 14 will, in attempting to return to a straightened condition, exert a compressive force on the strip 15 on the convex side and, conversely, strip 15 on the convex side, in attempting to return to a straightened condition, will exert a tensioning force on inside strip 16.

The number of radiating struts 11 may be varied greatly depending on the size and purpose of the dome. In general, the struts are arranged in diametrically-disposed pairs extending outwardly from opposite sides of hub 12 so that in the final skeletal structure there will be at least two opposing struts 11 interconnected by a central member are fixed in place, upper members 15 are flexed downwardly and secured to the cores 14.

While in the foregoing an embodiment of the invention has been disclosed in considerable detail for purposes of illustration, it will be understood by those skilled in the art that many of these details may be varied without departing from the spirit and scope of the invention.

I claim:

1. A method for forming a skeletal dome structure in situ, comprising the steps of arranging a plurality of substantially straight, elongated, and flexible lower strips of high compressive and tensile strength about a central hub with said lower strips disposed generally horizontally and radiating outwardly from said hub; each of said lower strips having an inner end located adjacent said hub and an outer end remote from said hub; securing a straight and horizontally-elongated flexible core to an upper surface of each of said lower strips, each lower strip and core being disposed in parallel relationship with the underside of said core being affixed along its length to the upper surface of the associated lower strip; connecting the inner end of each of said lower strips to said hub; then shifting said hub upwardly while simultaneously advancing the outer ends of all of said lower strips and cores radially inwardly to cause flexure of each of said lower strips and cores to produce a longitudinal convex curvature along the top of each core; then anchoring the outer end of each lower strip in place; and thereafter securing a flexible upper strip of high compressive and tensile strength along the convex top surface of each core.

2. The method of claim 1 in which said upper strips are secured to the top surfaces of said cores along substantially the full length thereof.

3. The method of claim 1 in which said upper strips are substantially straight when in untensioned condition and are flexed into arcuate configuration and into contact with said cores along substantially the full length thereof only after said lower strips have their outer ends anchored in place.

4. The method of claim 3 in which the inner ends of said upper strips are connected to said hub before said hub is shifted upwardly and said lower strips and cores are flexed.

* * * * *